US005120350A

United States Patent [19]

Supan et al.

[11] Patent Number: 5,120,350

[45] Date of Patent: Jun. 9, 1992

[54] FUSED YTTRIA REINFORCED METAL MATRIX COMPOSITES AND METHOD

[75] Inventors: Edward C. Supan, Chatsworth; Joseph F. Dolowy, Jr., West Hills, both of Calif.; Bradley A. Webb, Las Vegas, Nev.

[73] Assignee: The Standard Oil Company, Cleveland, Ohio

[21] Appl. No.: 547,664

[22] Filed: Jul. 3, 1990

[51] Int. Cl.[5] ..... C22C 29/12

[52] U.S. Cl. ..... 75/232; 419/19; 419/48

[58] Field of Search ..... 75/232; 419/19, 48

[56] References Cited

U.S. PATENT DOCUMENTS

| | | | |
|---|---|---|---|
| 3,507,630 | 4/1970 | Rezek | 29/182.5 |
| 3,864,093 | 2/1975 | Wolfla | 29/195 |
| 4,259,112 | 3/1981 | Dolowy, Jr. et al. | 75/208 |
| 4,398,969 | 8/1983 | Melton et al. | 148/11.5 |
| 4,402,746 | 9/1983 | Ramanarayanan et al. | 75/252 |
| 4,578,114 | 3/1986 | Rangaswamy et al. | 75/252 |
| 4,601,874 | 7/1986 | Marty et al. | 419/23 |
| 4,619,699 | 10/1986 | Petkovic et al. | 75/252 |
| 4,717,435 | 1/1988 | Kawasaki et al. | 148/410 |
| 4,885,214 | 12/1989 | Trenkler et al. | 428/614 |

FOREIGN PATENT DOCUMENTS 2091242 12/1971 France .

OTHER PUBLICATIONS

"Structure and Properties of Dispersion Strengthened Condensates", B. A. Movchan et al.; Thin Solid Films, 111 (1984), 285-291.

"Effect of Yttrium Oxide Volume Fraction . . . Superalloy", Metallurgical Transactions, vol. 5 (1974), J. S. Benjamin et al.

"Very High Temperature Titanium Bas Materials", R. A. Amato et al., Interim Report No. 4, Contract F33615-86-C-5073.

"Study of Intermetallic Compounds . . . TiAl", Technical Report AFML-TR-76-107, Jul. 1976.

"Comparative Tensile Properties", Advanced Materials & Processes 7 (1989).

"Influence of Rare-Earth Additions . . . Alloys", May 31, 1989 Technical Report for Apr. 1, 1977-Mar. 31, 1978.

Derwent Abstract Nos. 391918, 3830031, 1935842, 342871, 1558956, 326869, 955865, 247303, 689610, 729560, 540754 and CA 107(14): 119387.

*Primary Examiner*—Stephen J. Lechert, Jr.

*Attorney, Agent, or Firm*—Michael F. Esposito; Larry W. Evans

[57] ABSTRACT

A reinforced metal composite comprised of a mixture of fused yttria and a metal matrix selected from the group consisting of Ti, Nb, Fe, Co, Ni, Ti alloy, Co based alloys aluminides of Ti, aluminides of Ni, aluminides of Nb and their mixtures. Preferably, the metal matrix is Ti or a Ti alloy which has a low Cl content (e.g. less than 0.15 wt. % Cl).

12 Claims, No Drawings

FUSED YTTRIA REINFORCED METAL MATRIX COMPOSITES AND METHOD

BACKGROUND OF THE INVENTION

This invention relates to powder metallurgy and in particular to the dispersion hardening of titanium or titanium alloys with yttria. In addition, the invention is also applicable to other metal or metal alloy matrices such as niobium, iron, nickel, cobalt based alloys, and aluminides of titanium and nickel.

There is considerable need to increase the elevated temperature strength and the use temperature of metal alloys, in particular, titanium structures. One approach to this problem is to reinforce the titanium with ceramic particulate material via powder-metallurgy process. The reinforced structure is fabricated by hot consolidation of the blended powder mix in a vacuum enclosure.

Titanium is extremely reactive with almost all materials at high temperatures with resultant embrittlement and/or formation of brittle intermetallic compounds. Therefore, the problem of increasing the strength of titanium at high temperatures has been extremely difficult to achieve.

U.S. Pat. No. 4,601,874 discloses a process of forming a titanium base alloy with small grain size which includes mixing the titanium alloy with rare earth oxides such as yttria and $Dy_2O_3$. The addition of these materials is in very small amounts. Moreover, the usual form of yttria utilized in the '874 patent is a fine powder which is really not suitable for use as a reinforcement material for a metal composite.

U.S. Pat. No. 3,507,630 discloses the dispersion hardening of zirconium using fused yttria. It does not disclose the use of fused yttria and titanium or any other alloy.

SUMMARY OF THE INVENTION

It is the primary object of the present invention to provide a composite material having increased elevated temperature strength.

It is another object of the present invention to provide a titanium or titanium alloy composite material having increased elevated temperature strength.

Additional objects and advantages of the invention will be set forth in part in the description that follows and in part will be obvious from the description, or may be learned by the practice of the invention. The objects and advantages of the invention may be realized and obtained by means of the instrumentalities and combinations particularly pointed out in the appended claims.

To achieve the foregoing objects and in accordance with the purpose of the invention, as embodied and broadly described herein, the composite of the present invention comprises a titanium or titanium alloy reinforced with fused yttria.

Preferably, the yttria is dispersed in the titanium and/or titanium alloy matrix in an amount equal to 5 to 40 volume percent. Most preferably, the yttria is dispersed in the titanium/titanium alloy matrix in an amount equal to about 10 to 30 volume percent.

In a further aspect of the present invention the process of producing a composite material having improved elevated temperature strength comprises mixing particulate titanium or titanium alloy particles with particles of fused yttria, heating the mixed particulate material under pressure for temperatures sufficient to consolidate the particulate material forming a reinforced metal matrix composite.

In a preferred embodiment of this aspect of the present invention the heating is between a temperature of between about 1800° F. to 2150° F. and the pressure is between about 10,000 to 20,000 psi.

While the invention will now be described in detail with reference to specific examples to titanium and titanium alloys, it should be understood that the invention is also applicable to other metals or metal alloys such as niobium, iron, nickel, and cobalt based alloys as well as aluminides of titanium, niobium, and nickel.

DETAILED DESCRIPTION OF THE INVENTION

The present invention is directed to novel titanium/titanium alloy composites reinforced with a ceramic material comprising fused yttria ($Y_2O_3$). In particular, the present invention is directed to a low chloride content titanium or a titanium alloy (i.e. Ti—Al—V) composite reinforced with a ceramic material comprising fused yttria ($Y_2O_3$).

In a preferred embodiment of the present invention the titanium/titanium alloy powder used to make the composite contains only a small amount of impurities such as Chloride (Cl. Preferably, the Ti/Ti alloy contains less than 0.15 wt % Cl, preferably less than 10 ppm Cl.

In a further preferred embodiment of the present invention the fused yttria is added to composite in particulate form with the particles varying in size from 1 to 44$\mu$, preferably between about 2 to 30$\mu$, especially preferred being 3 to 20$\mu$.

In still another preferred embodiment of the present invention the fused yttria is added to the metal or metal alloy particles in a volume percent of between 5 to 40, preferrably 10 to 30, especially preferred being 10 to 20.

The fused yttria particulate utilized in the practice of the present invention was purchased from a Norton Co. of Worcester, Mass. The particle size of the fused yttria purchased were 800F or 600F. The term "F" refers to a Norton Company classification of particles and is defined as having a coarse-end control particle size distribution.

The reinforced metal composite of the present invention may be manufactured by powder metallurgy. In particular, the reinforced metal matrix is fabricated by hot isosatic pressing (HIP). For example, the particulate metal/metal alloy and fused yttria particles are mixed together in the appropriate proportions, the particulate mixture is then heated under high pressure for a time sufficient to consolidate the particles to form the reinforced composite. Typicall, HIP processing may be performed at a temperature of 500° F. to 2300° F., preferably 1000° F. to 2200° F., especially preferred being between 1800° F. to 2150° F. and a pressure ranging from 500 to 2500 psi, preferred being 3000 to 20,000 psi, especially preferred being 10,000 to 20,000 psi.

The following examples are presented for illustrative purposes only.

EXAMPLE 1

A titanium powder compact having fused yttria particles as a reinforcement was prepared for HIP consolidation by mixing 10 volume percent $Y_2O_3$ with 90 volume percent low chloride Ti powder (low chloride composite—i.e. less than 5 ppm). The mixed powders are placed in a container for compacting (HIP consolidation) at a temperature of 1900° F., pressure (argon) of 15,000 psi for three hours. A consolidated billet comprising the reinforced matrix was produced.

EXAMPLE 2

The procedure of Example 1 was followed except that the particulate mixture consisted of 10 volume percent $Y_2O_3$ and 90 volume percent Ti—6Al—4V premix. The premix powder was a blend of 90 percent low chloride Ti and 10 percent master alloy (60% Al 40% V).

EXAMPLE 3

The procedure of Example 2 was followed except that the particulate mixture consisted of 20 volume percent $Y_2O_3$ and 80 volume percent Ti—6Al—4V premix.

The canned billets produced in Examples 1 to 3 were extruded into 3 inch ×0.5 inch rectangular bars under the following condition:

TABLE I

| | Billet Preheat Temp °F. | Peak Force (Tons) | Peak Pressure KSI* | Extruded Length (inches) |
|---|---|---|---|---|
| Example 1 | 1550 | 1393 | 94.7 | 138 |
| Example 2 | 1850 | 1199 | 81.5 | 138 |
| Example 3 | 1850 | 1432 | 97.4 | 148 |

Container size: 6.12 in diameter*.
Extrusion Ration: 19.6
Ram Speed: 15 in/min
*Pressure based on billet cross-section after filling container The resulting hot extruded reinforcement composites were then mechanical tested under various conditions and the results are set forth below in Tables II to V.

TABLE II

TENSILE TEST RESULTS FOR HOT EXTRUDED BAR MADE FROM COMPOSITE OF EXAMPLE 1 (10% YTTRIA/90% Ti)

| TEST TEMP. °F. | E, msi | YS, ksi | UTS, ksi | εf, % | RA, % | HRC |
|---|---|---|---|---|---|---|
| RT | 16.9 | 81.3 | 95.4 | >6.65 | 4.17 | 25.0 |
| RT | 17.3 | 79.1 | 94.5 | >2.21 | 6.62 | 26.0 |
| RT | 16.8 | 81.2 | 94.3 | >2.24 | 5.20 | 26.5 |
| 400 | | 36.0 | 57.2 | 14.00 | 13.10 | |
| 600 | | 20.4 | 53.3 | 8.50 | 8.50 | |
| 800 | | 16.4 | 27.8 | 11:00 | 27.60 | |
| 1000 | | 16.0 | 28.7 | 19.00 | 27.60 | |
| 1200 | | 9.8 | 14.5 | 31.00 | 44.00 | |

E = Young's Modulus
YS = Yield Strength, 0.2% Offset
UTS = Ultimate Tensile Strength
εf = Strain at Fracture (RT); Elongation in 1 inch at elevated temperature
RA = Reduction in Area
HRC = Rockwell C Hardness

TABLE III

ROOM TEMPERATURE TENSILE TEST RESULTS FOR EXTRUDED BAR OF EXAMPLE 2 (10 v/o YTTRIA/Ti—6Al—4V)

| CONDITION | E, msi | YS, ksi | UTS, ksi | εf, % | RA, % | HRC |
|---|---|---|---|---|---|---|
| As-Extruded | 18.5 | 138.1 | 145.0 | 2.58 | 4.28 | 39.0 |
| | 18.2 | 139.6 | 149.6 | 2.99 | 1.07 | 41.0 |
| | 17.3 | 147.9 | 151.4 | 2.17 | 1.88 | 38.0 |
| Annealed | 17.6 | 147.4 | 153.9 | 2.42 | 2.69 | 36.0 |
| | 18.0 | 145.3 | 150.5 | 2.20 | — | 37.0 |
| | 17.3 | 140.2 | 148.3 | 2.63 | 1.71 | 35.0 |
| 1500° F.-STA | 17.6 | 156.3 | 161.8 | 2.17 | 2.47 | 37.5 |
| | 17.8 | 156.5 | 162.6 | 1.88 | 2.46 | 37.0 |
| 1700° F.-STA | 17.5 | 157.1 | 165.6 | 1.72 | 1.62 | 36.0 |
| | 18.0 | 152.2 | 160.6 | 2.17 | 4.25 | 39.0 |
| | 17.8 | 150.6 | 161.9 | 2.79 | 1.29 | 39.0 |
| 1900° F.-STA | 17.8 | 150.6 | 150.6 | 1.07 | 1.39 | 39.0 |

TABLE III-continued

ROOM TEMPERATURE TENSILE TEST RESULTS FOR EXTRUDED BAR OF EXAMPLE 2 (10 v/o YTTRIA/Ti—6Al—4V)

| CONDITION | E, msi | YS, ksi | UTS, ksi | εf, % | RA, % | HRC |
|---|---|---|---|---|---|---|
| | 17.4 | 151.1 | 159.5 | 3.26 | 2.25 | 39.0 |
| | 18.6 | 152.5 | 160.2 | 2.33 | 2.46 | 39.5 |

E = Young's Modulus
YS = Yield Strength, 0.2% Offset
UTS = Ultimate Tensile Strength
εf = Strain at Fracture (RT); Elongation in 1 inch at elevated temperature
RA = Reduction in Area
HRC = Rockwell C Hardness
Anneal: 1350° F., 1 hour, cooled at 5° F./min to 1000° F., AC
STA Heat Treatments: 30 min. at the indicated solution temperature, water quenched; aged 4 hours at 1000° F., AC

TABLE IV

TENSILE TEST RESULTS FOR EXTRUDED BAR OF EXAMPLE 3 (20 v/o YTTRIA/Ti—6Al—4V)

| CONDITION | TEST TEMP. °F. | E, msi | YS, ksi | UTS, ksi | εf, % | RA, % | HRC |
|---|---|---|---|---|---|---|---|
| As-Extruded | RT | 19.0 | 114.5 | 128.8 | 1.95 | 1.21 | 42.5 |
| | RT | 18.5 | 125.1 | 129.7 | 1.38 | 1.61 | 43.0 |
| | RT | 17.1 | 128.2 | 131.1 | 1.15 | 1.49 | 41.0 |
| Annealed | RT | 18.8 | 124.1 | 128.0 | 0.95 | — | 40.5 |
| | RT | 17.9 | 123.0 | 128.7 | 1.07 | — | 40.0 |
| | 800 | — | 71.0 | 76.3 | 0.50 | 1.1 | — |
| 1500° F.-STA | RT | 18.4 | 126.6 | 129.3 | 0.89 | — | 42.5 |
| | RT | 17.3 | — | 129.1 | 0.93 | — | 42.0 |
| 1700° F.-STA | RT | 18.0 | 126.4 | 126.4 | 0.90 | — | 42.0 |
| | RT | 18.3 | 126.9 | 132.7 | 1.02 | — | 41.5 |
| | 600 | — | — | 86.7 | 0.50 | 1.1 | — |
| | 800 | — | — | 85.3 | 1.00 | — | — |
| | 1000 | — | 75.3 | 78.2 | 1.50 | — | — |

E = Young's Modulus
YS = Yield Strength, 0.2% Offset
UTS = Ultimate Tensile Strength
εf = Strain at Fracture (RT); Elongation in 1 inch at elevated temperature
RA = Reduction in Area
HRC = Rockwell C Hardness
Anneal: 1350° F., 1 hour, cooled at 5° F./min to 1000° F., AC
STA Heat Treatments: 30 min. at the indicated solution temperature, water quenched; aged 4 hours at 1000° F., AC

TABLE V

ELEVATED TEMPERATURE TENSILE TEST RESULTS FOR EXTRUDED BAR OF EXAMPLE 2 (10 v/o YTTRIA/Ti—6Al—4V)

| CONDITION | TEST TEMP. °F. | 0.2% YS, ksi | UTS, ksi | ELONGATION % | RA, % |
|---|---|---|---|---|---|
| Annealed | 400 | 98.2 | 107.9 | 5.0 | 12.5 |
| | 600 | 87.7 | 97.1 | 5.5 | 6.5 |
| | 600 | 89.3 | 97.8 | 5.0 | 6.5 |
| | 800 | 78.2 | 88.2 | 2.0 | 7.6 |
| | 800 | 76.8 | 89.3 | 5.0 | 6.5 |
| | 1000 | 66.2 | 72.3 | 4.5 | 5.5 |
| | 1000 | 67.5 | 73.8 | 3.5 | 8.5 |
| | 1200 | 43.8 | 53.7 | 5.5 | 13.5 |
| | 1200 | 46.4 | 55.5 | 8.0 | 13.5 |
| | 1400 | 23.1 | 30.5 | 14.0 | 19.5 |
| 1500° F.-STA | 600 | 85.4 | 98.2 | 4.5 | 10.4 |
| | 800 | 79.5 | 89.9 | 3.5 | 9.4 |
| | 1000 | 68.2 | 79.7 | 4.0 | 9.4 |
| 1700° F.-STA | 400 | 112.7 | 123.8 | 3.0 | 9.5 |
| | 400 | 115.6 | 125.5 | 3.0 | 9.5 |
| | 600 | 99.6 | 106.0 | 2.0 | 7.6 |
| | 600 | 95.4 | 108.1 | 3.0 | 6.5 |
| | 800 | 87.3 | 98.2 | 1.5 | 9.8 |
| | 800 | 87.9 | 93.4 | 3.5 | 8.5 |
| | 1000 | 75.1 | 85.8 | 5.5 | 6.5 |
| | 1000 | 74.8 | 83.8 | 3.0 | 7.5 |
| | 1200 | 49.4 | 52.4 | 8.5 | 13.5 |
| | 1200 | 46.0 | 50.9 | 8.5 | 11.5 |
| | 1400 | * | 33.8 | 15.0 | 18.5 |
| 1900° F.-STA | 400 | 113.1 | 119.9 | 3.5 | 6.5 |
| | 600 | 96.3 | 106.6 | 4.5 | 8.5 |
| | 800 | 83.1 | 91.5 | 3.5 | 10.5 |
| | 800 | 84.6 | 98.0 | 3.0 | 8.5 |

TABLE V-continued

ELEVATED TEMPERATURE TENSILE TEST RESULTS FOR EXTRUDED BAR OF EXAMPLE 2 (10 v/o YTTRIA/Ti—6Al—4V)

| CONDITION | TEST TEMP. °F. | 0.2% YS. ksi | UTS. ksi | ELONGATION % | RA. % |
|---|---|---|---|---|---|
| | 1000 | 71.0 | 80.5 | 3.5 | 6.5 |
| | 1000 | 72.6 | 79.4 | 3.0 | 7.5 |
| | 1200 | 48.4 | 56.2 | 8.5 | 11.5 |

*Extensometer slipped; YS not determined

Table II shows tensile test results for the composition of Example 1. The average elastic modulus is 17.0 msi which is about 10% higher than unalloyed titanium (15.5 msi).

Table IV shows tensile test results for 20 v/o yttria (Example 3). The lack of heat treating response is attributed to incomplete alloying of the 60% Al-40V the master alloy with the titanium.

The III and V show the results for material of the composition of Example 2 (10 V % $Y_2O_3$/Ti—6Al—4V. The average elastic modulus for this composite is 17.8 msi which is about 2 msi higher than for unreinforced Ti—6Al—4V alloy. In addition, the material responded well to STA heat treatment.

The foregoing description of the preferred embodiments of the invention has been presented for purposes of illustration and description. It is not intended to be exhaustive or to limit the invention to the precise form disclosed. Obviously, many modifications and variations are possible in light of the above disclosure. The embodiments were chosen and described in order to best explain the principles of the invention and its practical application to thereby enable others skilled in the art to best utilize the invention in various embodiments and modifications. It is intended that the scope of the invention be defined by the claims appended hereto.

What is claimed is:

1. A metal composite comprising a mixture of fused yttria dispersed in a metal matrix wherein said metal is selected from the group consisting of Ti, Nb, Fe, Ni, Co, Ti alloys, Co based alloys, aluminides of Ti, Nb and Ni and mixtures thereof.

2. The metal composite of claim 1 wherein said metal matrix is Ti.

3. The metal composite of claim 1 wherein said metal matrix is a Ti alloy.

4. The metal composite of claim 2 wherein said metal matrix is a low chloride containing Ti metal.

5. The metal composite of claim 3 wherein said metal matrix is a low chloride containing Ti alloy.

6. The metal composite of claim 4 wherein said Ti contains less than 0.15 wt. % Cl.

7. The metal composite of claim 5 wherein said Ti alloy contains less than 0.15 wt. % Cl.

8. The metal composite of claim 7 wherein said Ti alloy comprises Ti—Al—V.

9. The composite of claim 2 wherein said fused yttria comprises between about 5 to 40 volume percent of said composite.

10. The composite of claim 7 wherein the amount of fused yttria is between about 5 to 30 volume percent.

11. The composite of claim 8 wherein the particle size of the fused yttria ranges from between 1 to 44 microns.

12. A process for preparing a metal reinforced composite comprising:

a. selecting a particulate metal matrix from the group consisting of Ti, Nb, Fe, Ni, Co, Al, Ti alloys, Co based alloys, aluminides of Ti, Nb, and Ni or mixtures thereof;

b. mixing said particles of said matrix material with particulate fused yttria to form a mixture; and c. heating said mixture at an elevated temperature and pressure for a time sufficient to consolidate said particles of said mixture forming a metal reinforced composite.

* * * * *